US006010003A

United States Patent [19]

Wilkinson

[11] Patent Number: 6,010,003

[45] Date of Patent: Jan. 4, 2000

[54] SHRINK PACKAGE

[75] Inventor: Timothy S. Wilkinson, Wooster, Ohio

[73] Assignee: KPC Master's Craft International, Inc., Wooster, Ohio

[21] Appl. No.: 09/088,264

[22] Filed: Jun. 1, 1998

Related U.S. Application Data

[63] Continuation-in-part of application No. 08/519,971, Aug. 28, 1995, abandoned.

[51] Int. Cl.[7] ..... B65D 69/00

[52] U.S. Cl. ..... 206/478; 206/497

[58] Field of Search ..... 206/461, 466, 206/478, 495, 497, 521

[56] References Cited

U.S. PATENT DOCUMENTS 4,411,364 10/1983 Friedman ..... 206/497 X 4,757,900 7/1988 Misset et al. ..... 206/497

*Primary Examiner*—Jacob K. Ackun

*Attorney, Agent, or Firm*—Timmons & Kelly

[57] ABSTRACT

A shrink-wrapping pallet (P) for packages includes a pallet member (150) having essentially rigid first and adjacent second sections (152 and 154). The first and second sections (152 and 154) each include an upper and lower surfaces (156, 168, 160 and 162) and opposing inner and outer edges (164, 166, 168 and 170). The first and second sections (152 and 154) are joined along the inner edges (164 and 166) of the first and second sections. The pallet (P) is adapted to hold a selected object (O) to be secured on the upper surface (156) of the first section (152) of the pallet member (150). A flexible film (172) is secured to the pallet member (150) near the outer edges (168 and 170) of the first and the second sections of the pallet member (150). A pocket (178) that is adapted to hold the object (O) to secured is formed between the upper surface (156) of the first section and an opposing lower surface (180) of the film (172).

12 Claims, 7 Drawing Sheets

SHRINK PACKAGE

This application is a Continuation-in-part of application Ser. No. 08/519,971, filed on Aug. 28, 1995 and now abandoned, and is related to application Ser. No. 08/519,968.

SPECIFICATION

BACKGROUND OF THE INVENTION

1. Technical Field

The invention relates to the field of shrink wrapped pallets and to methods and apparatus for preparing shrink wrapped pallets for securing objects.

2. Background Art

The process of shrink wrapping articles is well known in the art. Typically, the article or collection of articles to be wrapped is first covered with a shrink film such as polyvinyl chloride or polypropylene soft shrink material. The wrapped article is then located within a surrounding environment that causes the shrink film to shrink or contract about the article. Typically, the air surrounding the wrapped article is heated to between 275° F. and 350° F. and blown onto the shrink film covered article while it is conveyed through a shrink tunnel. The hot air shrinks the shrink film onto the article. If the article happens to be flat and flimsy or easily warped or curled or bent, then the pressure exerted on the article by the shrinking shrink wrap is frequently enough to cause distortion or bending of the article.

Alternatively, if one wishes to wrap larger or heavier articles, then one faces a similar set of problems as with small or flimsy articles. Bulky articles may be difficult to pass through the shrink tunnel or need additional support for transportation. Adding a backer board may provide necessary support, but may also reduce the efficiency of the shrink process by absorbing the heat used to shrink the shrink wrap.

Additionally, the typical shrink wrap that has been used heretofore is not reusable. Once the article to be wrapped has the shrink film shrunk about it, the user normally tears the shrink wrap in the removal process. Nor can the shrink wrap normally be reused for an article having even slightly different dimensions due to the shrink wrap matching the contours of the article about which it is shrunk.

Relating to the collapsible boxes known prior to the present invention, typically the foldable cardboard boxes such as those manufactured by Fellowes Manufacturing Co. of Itasca, Ill. 60143 are assembled by folding a series of flaps to form a box with sides having holes for carrying the box by the user. However, these typical types of storage boxes have no means to secure objects placed within the box from slipping about the carton. If articles were loosely placed in such boxes, the articles would move within the box as the box is turn upside down or otherwise undesirably moved. No means are typically provided to "lock-in" an article to be transported within the box.

While the above cited references introduce and disclose a number of noteworthy advances and technological improvements within the art, none completely fulfills the specific objectives achieved by this invention.

DISCLOSURE OF INVENTION

In accordance with the present invention, a shrink-wrapping pallet for protecting packages is also disclosed. The shrink-wrapping pallet of the present invention includes a pallet member that is formed having essentially rigid first and adjacent second sections. The first section and the second section each include an upper and a lower surface and opposing inner and outer edges. The first and second sections of the pallet member are joined along the inner edge of the first section and the inner edge of the second section. The pallet member is adapted to hold a selected object to be secured on the upper surface of the first section of the pallet member.

A flexible film that has first and second ends is secured to the pallet member near the outer edges of the first and the second sections of the pallet member. A pocket that is adapted to hold the object to secured is formed between the upper surface of the first section of the pallet member and an opposing lower surface of the film.

Further, the pallet member is adapted to fold between the first section and the second section along a primary axis between the inner edge of the first section and the inner edge of the second section of the pallet member. The second section rotates about the primary axis such that the lower surface of the second section can move into an opposing relationship to the lower surface of the first section. The rotation of the second section tightens the film about the selected object to be wrapped and consequently reduces the size of the pocket.

Also disclosed is a method and an apparatus for making the shrink packaging of the present invention that is adapted to receive an article to be packaged. The shrink package making apparatus includes a conveyer for moving a rigid substrate beneath a flexible wrapping feed that extends a flexible wrapping material over a top surface of the rigid substrate. An extension assembly extends a desired length of the flexible wrapping material from a flexible wrapping material supply over the top surface of the rigid substrate forming a pocket between the top surface of the rigid substrate and a bottom surface of the flexible wrapping material. A trimmer cuts the desired length of the extended flexible wrapping material from the flexible wrapping material supply. The two opposing ends of the length of the flexible wrapping material is attached to the opposing ends of the rigid substrate. A tuck is inserted in the flexible wrapping material between the opposing ends.

The present invention differs from the known types of packaging such as sleeve wrapping, bundle wrapping and skin wrapping in that a package can be opened and reclosed without the use of additional machinery. The present invention is also likely to be a fraction of the cost of the following known types of packaging: "foam in place," molded polyethylene, polypropylene styrene, urethane foam, air bladders, and styrene dunnage. Additionally, both the rigid substrate forming the pallet member and the flexible film of the present invention can be recycled.

These and other objects, advantages and features of this invention will be apparent from the following description taken with reference to the accompanying drawings, wherein is shown the preferred embodiments of the invention.

BRIEF DESCRIPTION OF DRAWINGS

A more particular description of the invention briefly summarized above is available from the exemplary embodiments illustrated in the drawing and discussed in further detail below. Through this reference, it can be seen how the above cited features, as well as others that will become apparent, are obtained and can be understood in detail. The drawings nevertheless illustrate only typical, preferred embodiments of the invention and are not to be considered limiting of its scope as the invention may admit to other equally effective embodiments.

MODE(S) FOR CARRYING OUT THE INVENTION

Figure 1:
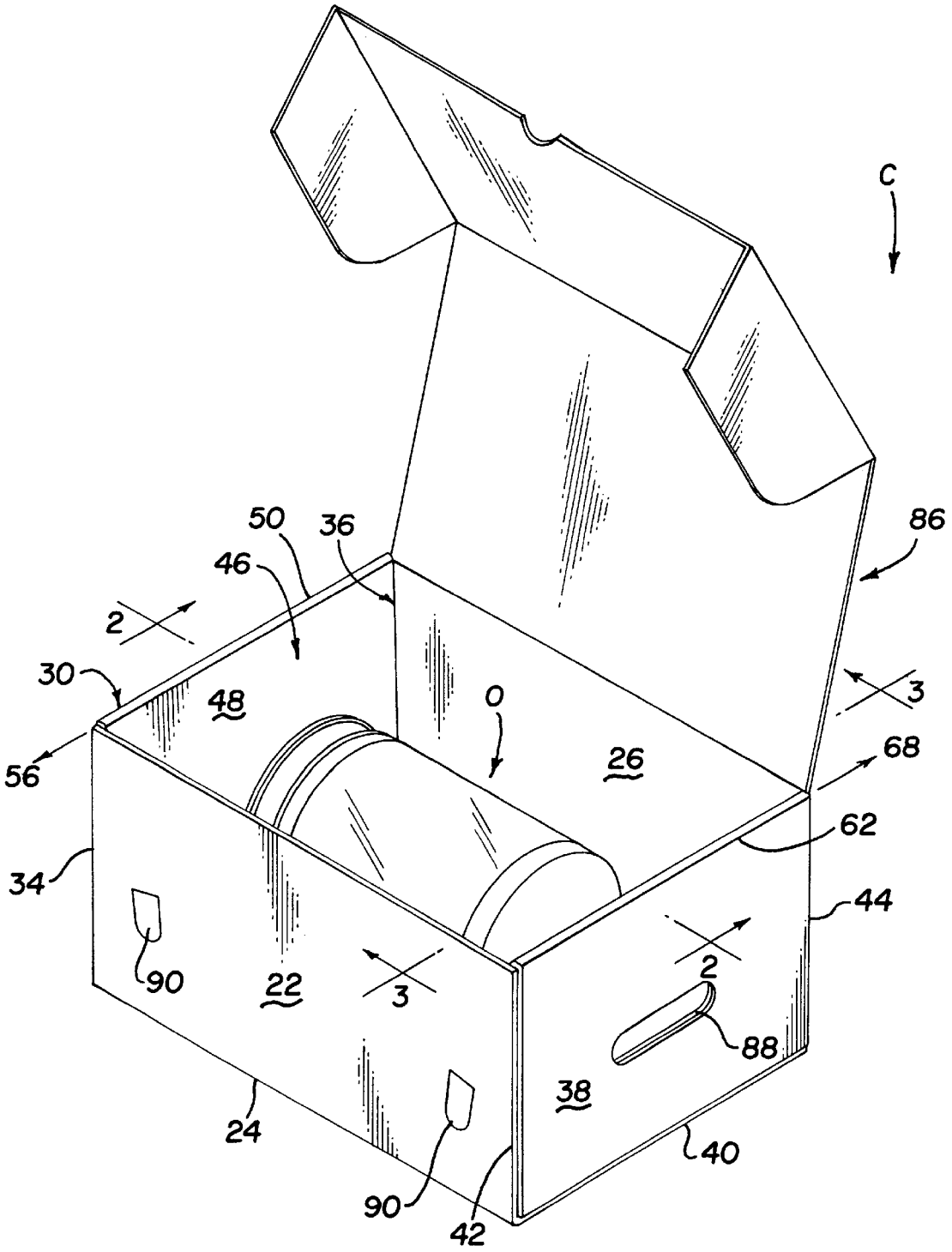
FIG. 1 is a front elevational view of the container of the present invention holding a selected object in the interior of the container.

So that the manner in which the above recited features, advantages and objects of the present invention are attained can be understood in detail, more particular description of the invention, briefly summarized above, may be had by reference to the embodiment thereof that is illustrated in the appended drawings. In all the drawings, identical numbers represent the same elements.

Container for Securing Objects Referring in particular to FIGS. 1–5, an improved container C for suspension of a selected object O to be secured is disclosed. Known containers of such type generally include a bottom member 20, a front side 22 extending upwardly from a front edge 24 of the bottom 20, a back side 26 extending upwardly from a back edge 28 of the bottom 20, a first side 30 extending upwardly from a first edge 32 of the bottom 20 and between a first edge 34 of the front 22 and a first edge 36 of the back 26, and a second side 38 extending upwardly from a second edge 40 of the bottom 20 and between a second edge 42 of the front 22 and a second edge 44 of the back 26. An inner chamber 46 is formed between the bottom 20, the front 22 and back 26, and the first and second sides 30 and 38, respectively.

A first extension flap 48 extends from an upper edge 50 of the first side 30. The first extension flap 48 has an inner surface 52 while the first side 30 also has an inner surface 54. The first extension flap 48 is pivotable about an upper first axis 56 parallel to a plane formed by the bottom 20, and the first extension flap 48 can be moved into a locked position 58 in which the inner surface 52 of the first extension flap 48 is adjacent the inner surface 54 of the first side 30. Similarly, a second extension flap 60 extends from an upper edge 62 of the second side 38. The second extension flap 60 has an inner surface 64 and the second side 38 has an inner surface 66. The second extension flap 60 is pivotable about an upper second axis 68 parallel to a plane formed by the bottom 20, and the second extension flap 60 can be moved into a locked position 70 in which the inner surface 64 of the second extension flap 60 is adjacent the inner surface 66 of the second side 38.

A first locking gap 72 is formed between a locking edge 74 of the first extension flap 48, the inner surface 54 of the first side 30, and an upper surface 76 of the bottom 20 when the first extension flap 48 is in the locking position 58. A portion 78 of a first object O to be secured in the inner chamber 46 is received in the first locking gap 72. For example, an edge or a portion of a pallet member 150, as described in more detail below, may be engaged or retained in the locking gap 72. Similarly, a second locking gap 80 is formed between a locking edge 82 of the second extension flap 60, the inner surface 66 of the second side 38, and the upper surface 76 of the bottom 20 when the second extension flap 60 is in the locking position 70 for receiving a different portion 84 of the first object O to be secured in the inner chamber 46.

The container or box C of the present invention may optionally include or be formed having a top member 86 to enclose the inner chamber 46 fully.

Desirably, an aperture 88 may be formed in one or more sides of the container C, such as in first side 30 and second side 38. The user or carrier of the container C would place their fingers through the apertures 88 to grip and carry the box C.

Preferably, at least one locking finger 90 is formed in one or more sides of the container C, such as front 22 or rear 26. Each locking finger 90 extends into the inner chamber 46 to retain a portion of the object O to be secured from undesired movement in the inner chamber. Typically, a "U" shaped cut will be made in the wall forming the finger and the bottom of the "U" cut is pushed slightly into the interior of the inner chamber 46.

In yet another embodiment, the locking edge 74 may include a projection member 92 to retain the locking edge 74 in a spaced apart relationship or at a selected distance from the inner surface 54 of the first side 30 when the first extension flap 48 is placed in the locking position 58. The projection member 92 may be a block of wood or one or more compression springs glued or otherwise attached to the inner surface 52 of the first extension flap 48 or a flap 96 pivotally mounted to the locking edge 74.

Likewise, the locking edge 82 of the second extension flap 60 may include a projection member 98 to retain the corresponding locking edge 82 in a spaced apart relationship or at a selected distance from the inner surface 66 of the second side 38 when the second extension flap 60 is placed in the locking position 70. The projection member 98 may also be a block of wood glued or otherwise attached to the inner surface 64 of the second extension flap 60 or a flap 100 pivotally mounted to the locking edge 82.

Figures 2, 3:
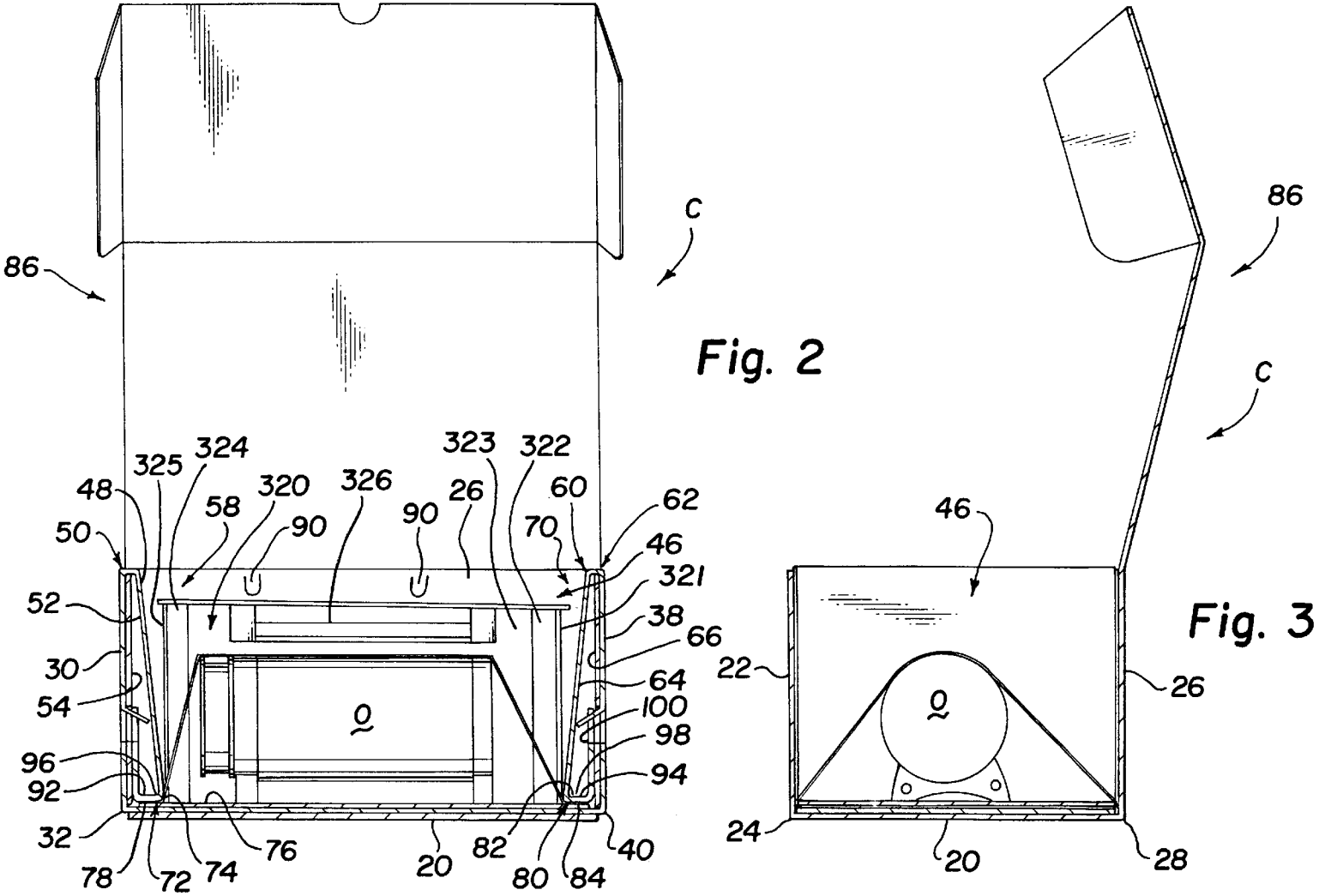
FIG. 2 is a cross sectional view of the container taken along line 2—2 of FIG. 1 and includes a second object in the interior of the container.
FIG. 3 is a cross sectional view of the container taken along line 3—3 of FIG. 1.

Referring to FIG. 2, the box or container C of the present invention may optionally include a spacer support member 320 having at least three essentially planar sides 321 through 325 perpendicular to the bottom 20 and forming a support at the top of the spacer member 320 and within the inner chamber 46 for a second object or load 326 to be secured. The spacer member 320 maintains the second article 326 in a spaced apart relationship from the first object O to be secured. The spacer member 320 is desirably formed from a sheet of corrugated fiberboard that has been scored to assist in proper folding of the sheet forming the sheet into a closed, hollow column or an open sided column that is placed around and over the first object O. The second object 326 to be secured is then placed on or suspended from the top of the spacer member 320 and extends into the hollow interior of the spacer member that was formed into the column. The second object 326 can be further secured by bending upper locking fingers 90 into the inner chamber 46 to lock or secure the second object 326 into the spaced apart position from the first object O.

Figure 4:
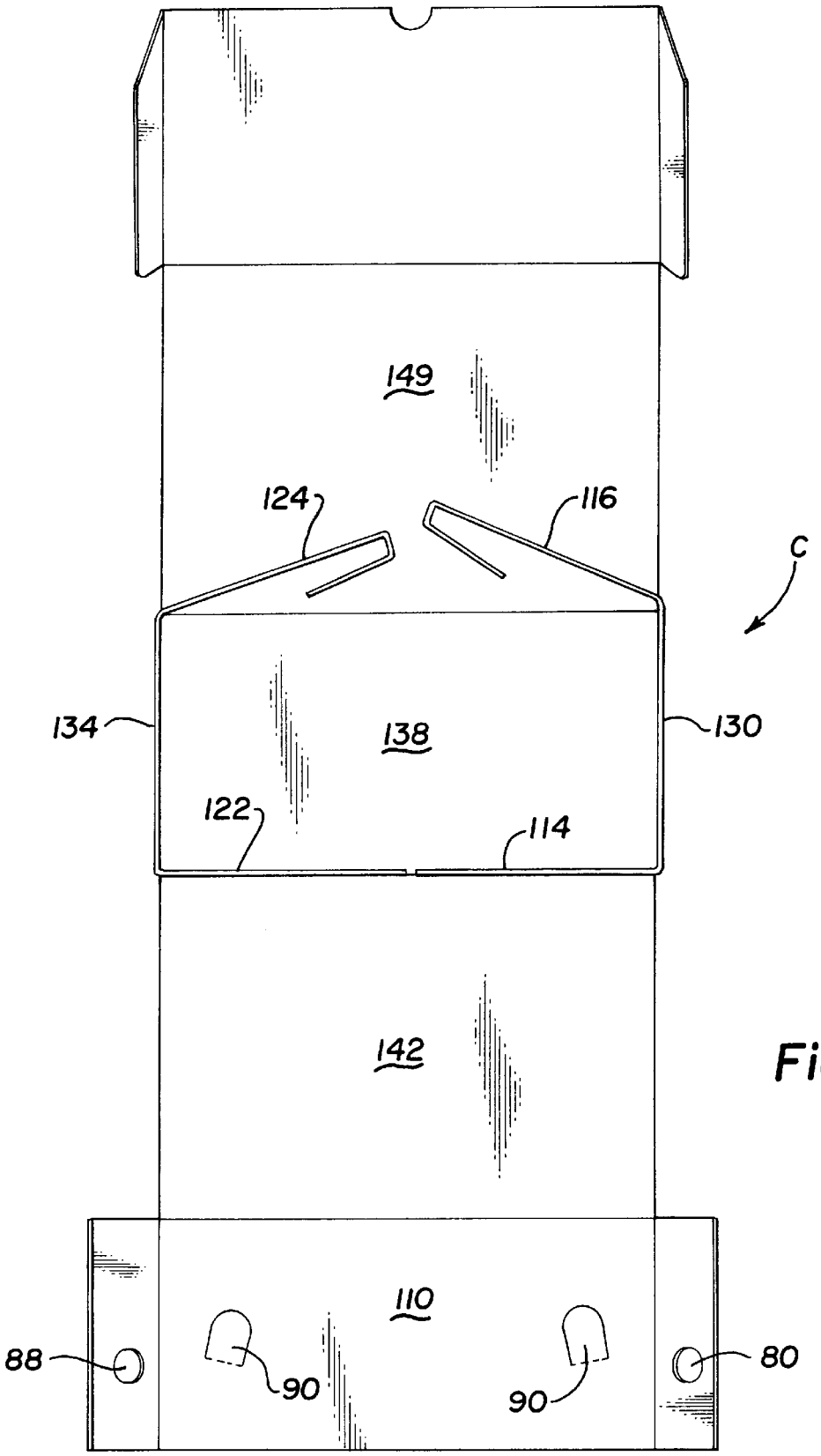
FIG. 4 is a plan view of the container of the present invention having been partially unfolded.
Figure 5:
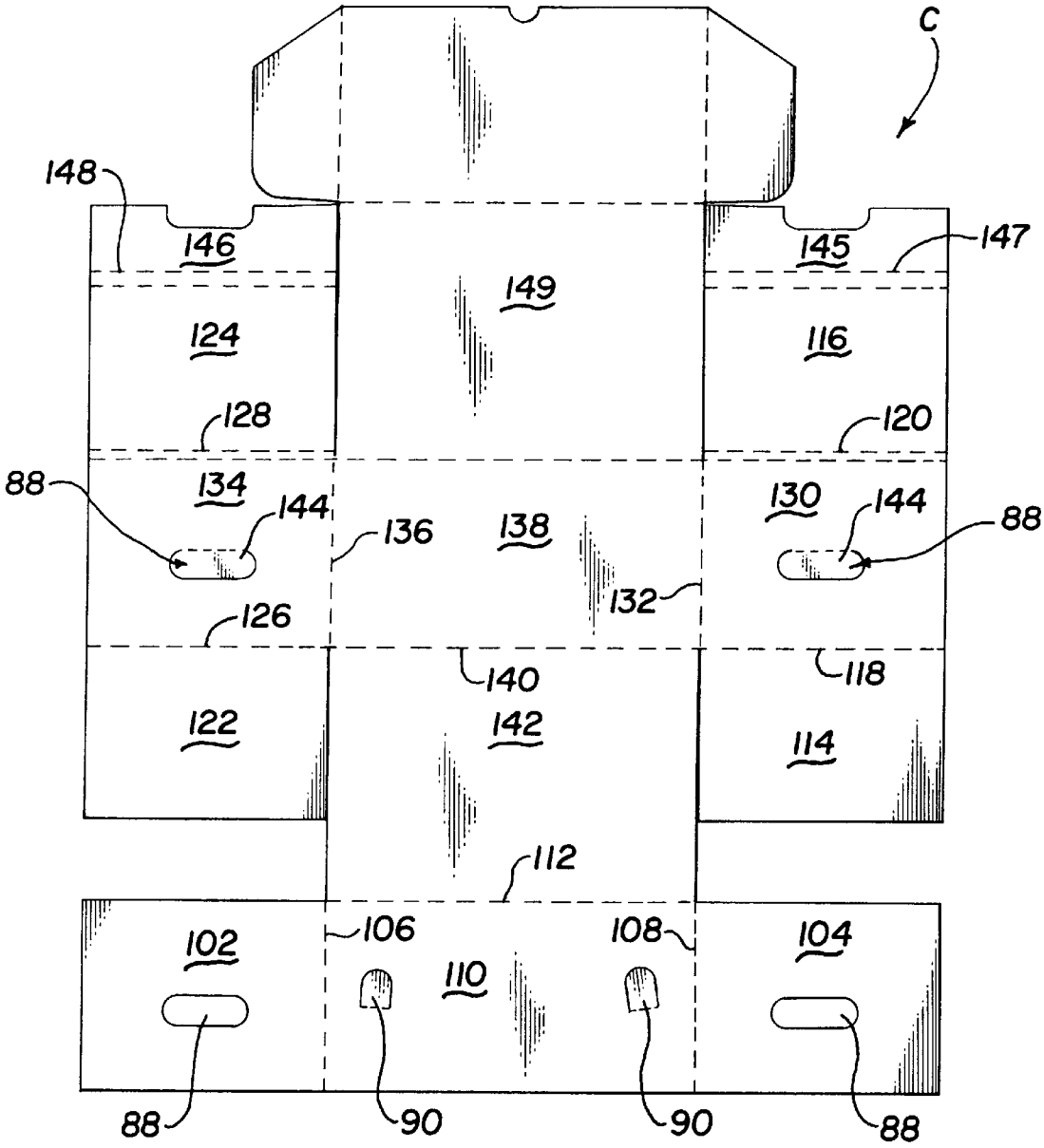
FIG. 5 is a plan view of a completely unfolded container of the present invention.
Figure 6:
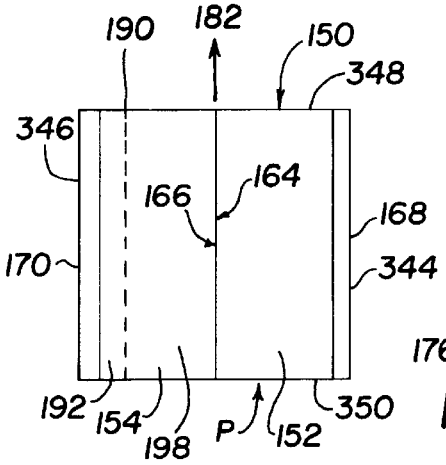
FIG. 6 is a top view of the pallet for shrink wrapping of the present invention.
Figure 7:
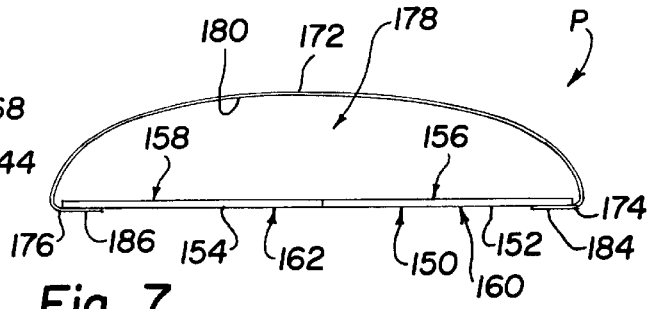
FIGS. 7 through 11 are side views of one embodiment of the pallet for shrink wrapping of the present invention showing the second section of the pallet member at various rotational positions.

Referring now in particular to FIGS. 4 and 5 that show a collapsed or unfolded container C, directions for folding or forming one embodiment of the box C of the present invention will be given using a series of flaps and folding lines. Typically, the box is constructed from a single sheet of corrugated fiberboard or cardboard. Referring to FIG. 5, the dotted folding lines shown typically are scored lines in the cardboard to assist in folding of the flaps.

First, flap 114 is folded upwards ninety degrees about folding line 118, and then flap 130 is folded ninety degrees upwardly about folding line 132. Correspondingly, flap 122 is folded upwards ninety degrees about folding line 126, and then flap 134 is folded ninety degrees upwardly about folding line 136. See FIG. 4 showing the folding of the box at this stage. Flap 138 is folded upwardly ninety degrees about folding line 140 placing the lower surfaces of flaps 122 and 114 on top of flap 142. Flaps 102 and 104 are folded upwardly ninety degrees about folding lines 104 and 106, then flap 110 is folded upwardly ninety degrees about folding line 112 with flaps 102 and 104 being placed inside the box and inside of flaps 130 and 134. Aperture flaps 144 may then be folded into the interior of the box to lock the sides together and to form the aperture 88 for gripping the box.

Flaps 145 and 146 are folded about folding lines 147 and 148, respectively, to form the projection members. The object O to be secured in then placed in the inner chamber of the box and flaps 116 and 124 are then folding down about folding lines 120 and 128 into the locking position.

Finally, the optional top flap 149 may be folded into place to close the box.

Shrink-Wrapping Pallet

Referring now in particular to FIGS. 6 through 11, a shrink-wrapping pallet or core back pack P for protecting packages O of the present invention includes a pallet member 150 that is formed having essentially rigid first 152 and adjacent second 154 sections composed of a rigid substrate material. The first section 152 and the second section 154 each include an upper 156 and 158, respectively, and a lower 160 and 162, respectively, surface and opposing inner 164 and 166, respectively, and outer 168 and 170, respectively, edges. The first and second sections 152 and 154 of the pallet member 150 are joined along the inner edge 164 of the first section 152 and the inner edge 166 of the second section 154. The pallet member 150 is adapted to hold a selected object O to be secured on the upper surface 156 of the first section 152 of the pallet member 150.

Preferably, the pallet member 150, the first section 152 and the second section 154 are in the shape of parallelograms. However, the size or shape of the first section 152 does not have to be the same as the second section 154, so long as the two sections 152 and 154 may be joined. The width 200 of the first section 150 between edges 164 and 168 is preferably wider than the width 202 of the object O to be secured on the first section 150.

A flexible film 172 that has first and second ends 174 and 176, respectively, is secured to the pallet member 150 near the outer edges 168 and 170 of the first 152 and the second sections 154 of the pallet member 150. The length of the film 172 between ends 174 and 176 is preferably longer than said pallet member when the pallet member 150 is in the flat position. See FIG. 7.

A pocket 178 that is adapted to hold the object O to secured is formed between the upper surface 156 of the first section 152 of the pallet member 150 and an opposing lower surface 180 of the film 172.

The pallet member 150 is also adapted to fold between the first section 152 and the second section 154 along a primary axis 182 between the inner edge 164 of the first section 152 and the inner edge 166 of the second section 154 of the pallet member 150. Generally, the primary axis 182 is parallel to the outer edges 168 and 170 of the first and second sections 152 and 154, respectively. The second section 154 rotates about the primary axis 182 such that the lower surface 162 of the second section 154 can move into an opposing relationship to the lower surface 160 of the first section 152. See FIG. 8. The rotation of the second section 154 tightens the film 172 about the selected object O to be wrapped and consequently reduces the size of the pocket 178.

One embodiment of the shrink-wrapping pallet P comprises a pallet member 150 forming a single sheet of a corrugated fiberboard having been scored along primary axis 182 for ease in pivoting or folding of the second section 154 about first section 152.

The pallet member 150 of an alternative embodiment includes two separate pieces of plywood or other rigid material that are hinged together with a rubber, plastic, leather, metallic or other type of hinge located between the first section 152 and the second section 154. Such an embodiment may be appropriate for heavier items, such as transmissions for automobiles, by way of example.

In yet another alternative, the first section 152 is formed having a tray member 188 for holding one or more smaller objects O. See FIG. 9.

Figure 10:
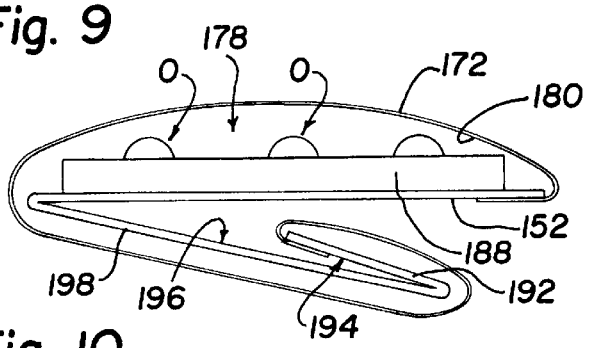

A secondary folding axis 190 may optionally be formed in second section 154. Such secondary axis 190 would be located between inner edge 166 and outer edge 170 of the second section 154. On outer portion 192 of the second section 154 may be folded about the secondary axis or score line 190 as is shown in FIG. 10. Rotating the outer portion 192 of the second section 154 about the secondary axis 190 into a position in which the lower surface 194 of the outer portion 192 is adjacent the lower surface 196 of an inner portion 198 of the second section 154 reduces the pocket 178 and tightens the flexible film 172 about the object O to be secured. Also, rotating the lower surface 194 of the outer portion 192 away from the inner portion's lower surface 196 enlarges the pocket 178.

The rigid substrate material forming the pallet member 150 can be of any form of rigid material including such materials as chip-board, corrugated fiberboard, plastic sheets, and plywood.

Figure 8:
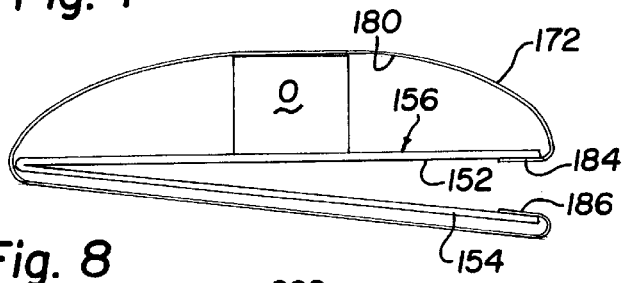
Figure 9:
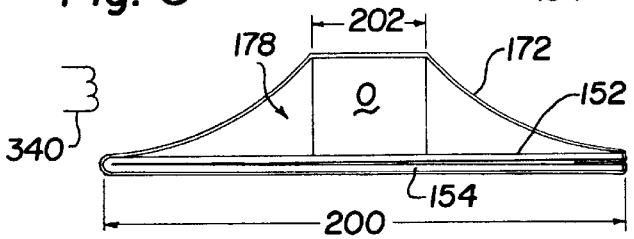

The flexible film 172 generally controllably shrinks when it is exposed to selected conditions, such as a heat source 340 schematically shown in FIG. 8. The film 172 may be, for example, any polypropylene, PVC, linear low density polyethylene, or hybrid biaxially oriented shrink film. The flexible film 172 may have the characteristics of having a memory of the object to be secured O and mold to the general shape or contours of the packaged product O. An example of such a plastic film is that manufactured by Crayex in Piqua, Ohio.

Figure 11:
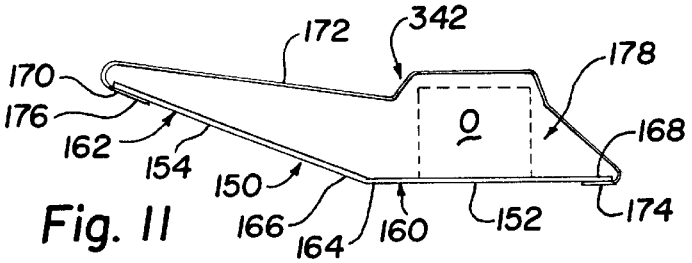

The bump 342 shown in FIG. 11 is an example of a flexible film 172 being formed generally following the contour of the packaged object O and having a memory.

The flexible film 172 may be attached to the pallet member by liquid glue, a glue spray, being stapled or any suitable means compatible with the choice of materials.

In general the present reusable shrink-wrapping pallet P for packages includes a pallet member 150 that is formed having essentially rigid first and adjacent second sections 152 and 154. The first section 152 and the second section 154 each include an upper and lower surface 156, 158 and 160, 162, and opposing inner and outer edges 164, 166 and 168, 170. The first and second sections 152 and 154 of the pallet member 150 are joined along the inner edge 164 of the first section and the inner edge 166 of the second section. The pallet member 150 is adapted to hold a selected object to be secured O on the upper surface 156 of the first section 152 of the pallet member 150. Also, the first section 152 of the pallet member 150 has a width 200 at least as wide 202 as the object to be secured O.

A known flexible film 172 extends across the pallet member 150. The film 172 has first and second ends 174, 176 that are secured to the pallet member 150 near the outer edges 168, 170 of the first and the second sections 152, 154 of the pallet member 150. An adjustable sized pocket 178 that is adapted to hold the object to secured O is formed between the upper surface 156 of the first section 152 of the pallet member 150 and an opposing lower surface 180 of the film 172.

The pallet member 150 is also adapted to fold between the first section 152 and the second section 154 along a primary axis 182 between the inner edge 164 of the first section 152 and the inner edge 166 of the second section 154 of the pallet member 150. The second section 154 is rotatable about the primary axis 182 such that the lower surface 162 of the second section 154 is able to move into an opposing relationship to the lower surface 160 of the first section 152. The pocket 178 is thereby reduced in size when the second section 154 is rotated about the primary axis 182 into a position in which the lower surface 162 of the second section 154 is adjacent the lower surface 160 of the first section 152, and correspondingly, the pocket 178 is increased in size when the lower surface 162 of the second section 154 is rotated away from the lower surface 160 of the first section 152. The controllable resizing of the pocket 178 permits the object to be secured to be removed from the pocket 178 of the pallet without tearing of the film 178 securing the object to be secured O. This permits the reuse of the present invention unlike previous packaging methods hereto before.

Figure 14:
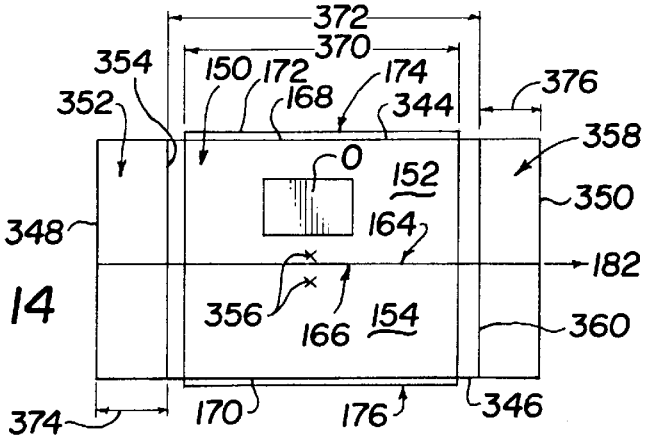
FIGS. 14 and 15 are top views of an alternative embodiment of the present pallet for shrink wrapping.
Figure 15:
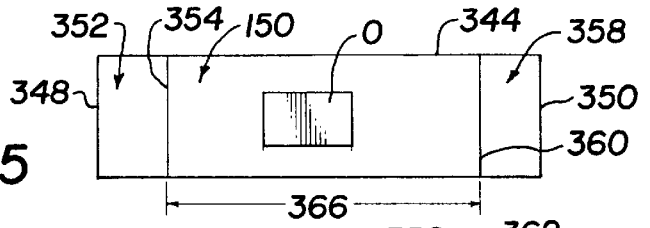

Referring particularly to FIGS. 14 and 15, yet another alternative embodiment of the present reusable shrink-wrapping pallet P for packages includes a pallet member 150 that is a rectangle having a first 344 and an opposing second 346 edges, and a third edge 348 that is perpendicular to the first edge 344, and finally a fourth edge 350 that opposes the third edge 348. The primary axis 182 is parallel to the outer edges 168, 170 of the first and second sections 152, 154. The outer edges 168, 170 of the first and second sections also correspond to the first and second edges 344, 346 of the pallet member 150.

Preferably the width 370 of film web 172 is approximately the width 372 of the pallet member 150 between axis or folding line 354 and axis or folding line 360. Also, the flexible film 172 has first and second ends 174 and 176, respectively, as is described above. The ends 174 and 176 are secured to the pallet member 150 near the outer edges 168 and 170 of the pallet member 150, and preferably on the undersides 160, 162. The length of the film 172 between ends 174 and 176 is preferably longer than said pallet member when the pallet member 150 is in the flat position.

A first ear segment 352 of the pallet member 150 is adapted to rotate about a first segment pivot axis 354 located between the third edge 348 of the rectangular pallet member 150 and a point that is midway 356 between the third and fourth edges 348, 350 of the rectangular pallet member 150 when the second section 154 is rotated about the primary axis 182 into a position in which the lower surface 162 of the second section 154 is adjacent to the lower surface 160 of the first section 152.

Similarly, a second ear segment 358 of the pallet member 150 is adapted to rotate about a second segment pivot axis 360 located between the fourth edge 350 of the rectangular pallet member 150 and the point that is midway 356 between the third and fourth edges 348, 350 of the rectangular pallet member 150 when the second section 154 is rotated about the primary axis 182 into a position in which the lower surface 162 of the second section 154 is adjacent to the lower surface 160 of the first section 152.

Figure 16:
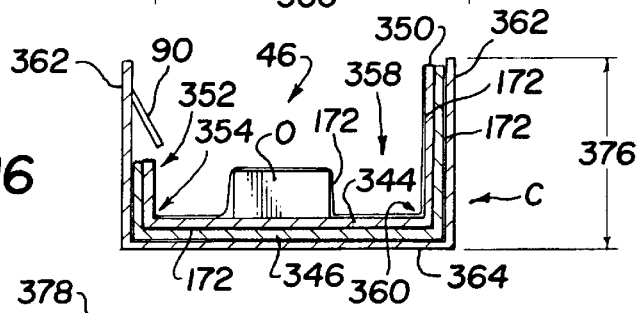
FIGS. 16 and 17 are cross sectional views of a container holding a folded alternative embodiment of the pallet shown in FIGS. 14 and 15.
Figure 17:
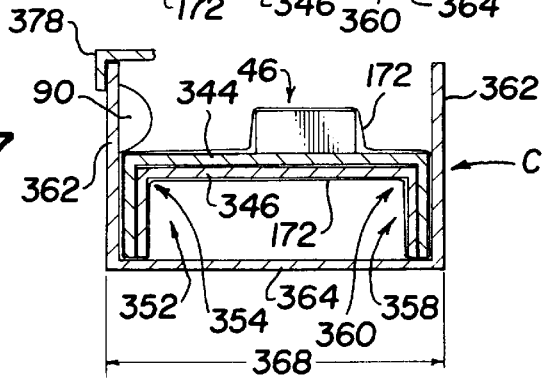

Referring now particularly to FIGS. 16 to 17, the alternative shrink wrap pallet generally shown in FIGS. 14 and 15 above is folded and is securing a package O. The pallet 150 is secured in a container C, such as is described above or any other suitable or similar container, having locking fingers 90 that extend from one or more sides 362 of the container C. The pallet 150 is placed in the interior 46 of the container C and above the bottom 364. The locking fingers 90 prevent the undesired movement of the pallet P during shipment of the loaded container.

The first and second ear segments 352, 358 cooperate with the fingers 90 to make fast the pallet P within the container C. FIG. 17 shows the ear segments being bent toward the bottom 364 of the container forming legs that support the package P more towards the middle of the interior 46 of the container. Whereas, FIG. 16 shows the ear segments being bent away from the bottom 264 of the container C placing the package P closer to the bottom 364 of the container. Since the pocket 178 is adjusted by the rotation of the second section 154 about the central axis 182, the direction of folding the first and second ear segments 352, 358 does not affect the size of the pocket 178.

It is preferred that the length 366 of the portion of the pallet 150 between the first pivot axis 354 and the second pivot axis 360 be approximately equal to or less than the inside distance or length 368 between the interior surfaces of the side walls 362 of the container C. If the length 366 were longer than the length 368, the pallet P would not fit within the container C. Alternatively, if the length 366 was too short compared to the length 368, the fingers 90 may not reach to secure the pallet P and the pallet P would be free to move around in the interior 46 of the container C.

With the combination of the container having locking fingers 90 and the reusable shrink wrapping pallet P, the user is able to package the object to be secured O and fix firmly the item for shipment. Once the package arrives at its ultimate destination, the pallet P can be removed from the container C and the package O extracted from the pallet P without tearing the film 172. Since the film 172 does not have to be torn to remove the object O, a similar shaped package O can be placed back in the pallet P thereby reusing the pallet.

Alternatively, the width 374 of the ears 352 and 358 from the edges to the fold lines 348 to 354 and 350 to 360, respectively, can be as long as the height or depth 376 of the wall or side 362 of the container C. This compatibility eliminates the need for finger tabs 90 or anything other than the box lid (not shown in FIG. 16) to secure the pallet in the box because the ears are the same length as the distance between the inside bottom of the box and the inside underside of the box lid (shown in cut-away in FIG. 17).

In operation, the product O can be placed under or in the pocket 178 or film 172 and the second section 154 be folded or rotated under where underside 162 is adjacent to the underside 160 of section 152, thereby reducing the size of the pocket. After this the two ears 352 and 358 are folded or rotated about their respective axis or fold lines in the desired direction to form a U shape.

Figure 18:
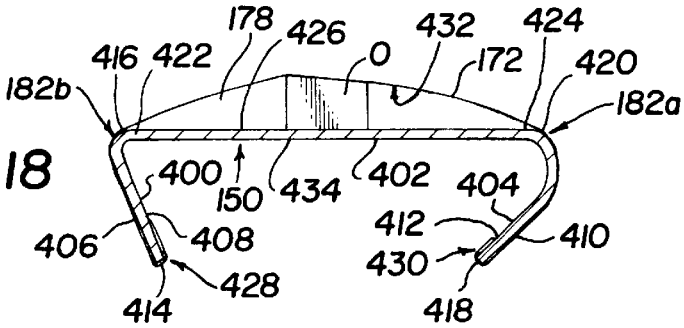
FIG. 18 is a cross sectional view of another alternative embodiment of the present pallet for shrink wrapping.

Still another alternative embodiment of FIG. 18 shows the reusable shrink wrapping pallet P for packages O including a pallet member 150 formed having essentially rigid rectangular first, main, and second sections 400, 402 and 404 respectively. The first section 400, and the second section 404 each have an upper and lower surface 406, 410 and 408, 412, respectively, and opposing inner and outer edges 414, 416 and 418, 420, respectively. The main section 402 has a first 422 and opposing second edge 424.

The first section 400 of the pallet member 150 is joined along the inner edge 416 of the first section 400 to the first edge 422 of the main section 400. The second section 404 of the pallet member 150 is joined along the inner edge 420 of the second section 404 to the second edge 424 of the main section 402. The pallet member 150 is adapted to hold a selected object to be secured O on an upper surface 426 of the main section 402 of the pallet member 150. The main section 402 of the pallet member 150 has a width that should be at least as wide as the object to be secured O.

A flexible film 172 has first and second ends 428 and 430 that are secured to the pallet member 150 near the outer edges of the first and the second sections 414 and 418 respectively of the pallet member 150. An adjustable sized pocket 178 is adapted to hold the object to secured O therein and is formed between the upper surface 426 of the main section 402 of the pallet member and an opposing lower surface 432 of the film 172.

As above, the pallet member being adapted to have the first section 400 rotatable with respect to the main section 402 along a first primary axis 182*b* between the inner edge 416 of the first section 400 and the first edge 422 of the main section 402 of the pallet member, such that the lower surface 408 of the first section 400 moves into an opposing relationship to the lower surface 434 of the main section 402. The second section 404 is likewise rotatable about a second primary axis 182*a* between the inner edge 420 of the second section 404 and the second edge 424 of the main section 402 of the pallet member such that the lower surface 412 of the second section 404 moves into an opposing relationship to the lower surface 434 of the main section 402.

The pocket 178 is reduced in size when the first section 400 is rotated about the first primary axis 182*b* into a position in which the lower surface 408 of the first section is adjacent the lower surface of the main section 402 and the pocket 178 is increased in size when the lower surface of the first section is rotated away from the lower surface 434 of the main section 402. Likewise, the pocket 178 is reduced in size when the second section 404 is rotated about the second primary axis 182*a* into a position in which the lower surface 412 of the second section 404 is adjacent the lower surface 434 of the main section 402, and the pocket 178 is increased in size when the lower surface 412 of the second section 404 is rotated away from the lower surface 434 of the main section 402.

Use of the Shrink-Wrapping Pallet

Generally, the pallet member 150 composed of the rigid substrate is given to the user with the film 172 attached to it at the edges 184 and 186 of the film 172. The user simply lifts up the film 172 forming the pocket 178, inserts the selected object or product O to be packaged, folds the second section 154 of the pallet member 150 downward, that is away from the product O, and passes the load through a known type of a shrink tunnel suitably sized. The film 172 shrinks tightly around the product or object O to be secured for transit purposes, for example. When the next user receives the shrink wrapped pallet package load, the user simply removes any shipping restraints, such as a box, unfolds the second section of the pallet and removes the product without having to cut the film 172.

If another similar product, or the old "to be replaced item," is to be returned, that second product is simply placed back under the film approximately in the position about which the film 172 has been deformed or molded about the former product. The second section 154 of the pallet is then folded downward again away from the product O making the film 172 once again tight without shrinking for reduced chances of damage in shipping the product back to the original shipper.

Apparatus for Forming Shrink Packages

Figure 12:
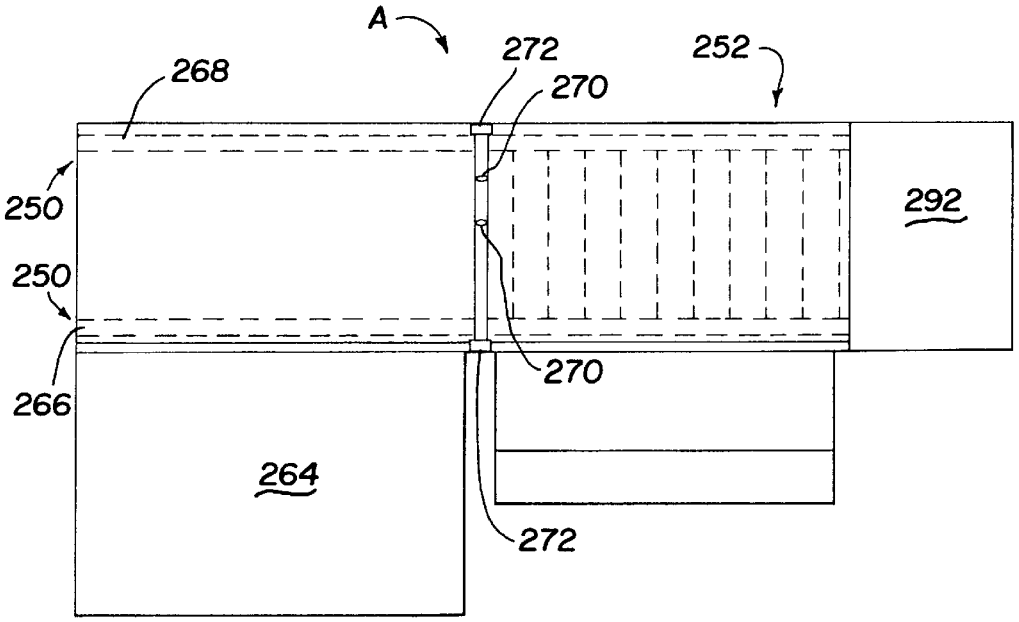
FIG. 12 is a top view of an apparatus according to the present invention for preparing the pallets for shrink wrapping.
Figure 13:
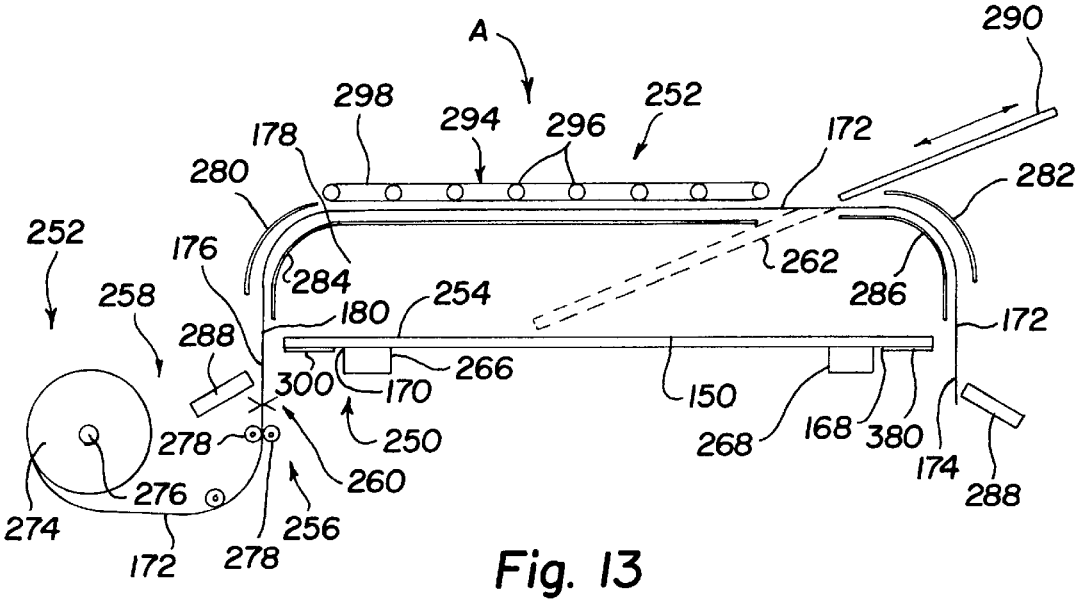
FIG. 13 is a cross sectional view of the apparatus for preparing the pallets for shrink wrapping.

Referring now to FIGS. 12–13, in general a system A for making shrink packaging P is adapted to receive an article O to be packaged. The present shrink package making apparatus A takes pre-cut to size substrate material, such as corrugated fiberboard, and scores it in one or more places. A conveyer 250 moves the pallet member 150 of the rigid substrate beneath a flexible wrapping feed assembly 252 that extends a flexible wrapping material 172 over a top surface 254 of the rigid substrate. An extension assembly 256 extends a desired length of the flexible wrapping material 172 from a flexible wrapping material supply 258 over the top surface 254 of the rigid substrate 150 forming a pocket 178 between the top surface 254 of the rigid substrate 150 and a bottom surface 180 of the flexible wrapping material 172. A trimmer 260 cuts the desired length of the extended flexible wrapping material 172 from the flexible wrapping material supply 258. The two opposing ends 174 and 176 of the length of the flexible wrapping material 172 is attached to the opposing ends 168 and 170 of the rigid substrate. A tuck 262 is inserted in the flexible wrapping material 172 between the opposing ends 174 and 180.

A vacuum feed rigid substrate hopper or loader 264 transfers the rigid substrate pallet member 150 in registration to preferably two vacuum belts 266 and 268 of the conveyer 250. One of the vacuum belts 266 may be of a fixed size, while the second vacuum belt 268 is preferably adjustable in order to accommodate various sizes of substrate pallet members 150.

One or more adjustable scoring wheels 270 are mounted after the loader 264. The scoring wheels 270 determine where the substrate pallet member 150 folds to create the opening and reclosing function of the package, as described above.

Two attaching heads 272 attach the flexible wrapping material 172 to the rigid substrate pallet member 150. The flexible wrapping material or film 172 may be glued, staple or stitch to the substrate pallet member 150. One attaching head 272 is mounted near the edge of each vacuum belt 266 and 268 and preferably directly across from each other.

A flexible material supply 258 includes one or more rolls 274 of the film 172 on racks 276 to allow for a controlled and smooth dispensing of the flexible material 172 as it is moved or extended across the substrate pallet member 150 prior to being attached. The flexible material feed 252 includes the flexible material supply 258 and a tensioning brake (not shown) to prevent the over-coasting or undesired length of the flexible film being pulled from the rolls 274.

A flexible material drive roller 278 peels the material off the roll or rolls 274 and feeds the film 172 into the plows as will be described. Two rigid outer forming plows or guides 284 and 286 with one on each side of the vacuum belts 266 and 268, respectively, direct the feeding of the film 172 over the rigid substrate pallet members 150 that were moved or positioned beneath the flexible wrapping material feed 252 by the vacuum conveyer 250. A mechanical or heated flexible material cut-off blade or trimmer 260 separates the desired length of film 172 from the remaining portion of the film from the rolls 274.

Generally, two adjustable height inner forming plows or guides 284 and 286 are mounted between the outer forming plows 280 and 282 and the vacuum conveyor belts 266 and 268 so as to not restrict the passage of the rigid substrate through the film feed assembly 252. The inner guides 284 and 286 support the film 172 from collapsing onto the top surface 254 of the rigid substrate as the film 172 is extended across the pallet member 150.

A film feeder segment 294 that is adapted to the film and the size of the substrate pallet member 150 feeds the flexible wrapping material 172 through the outer 280 and 282 and inner 284 and 286 plows or guides from one side 170 of the substrate pallet member 150 to the other side 168. Generally, the film feeder segment 294 includes several rollers 296 and one or more continuous belts 298 that frictionally engage the film 172.

One or more tuck plates 288 tuck the ends 174 and 176 of the flexible wrapping material 172 to the exposed underside edges 168 and 170 of the rigid substrate to secure the opposing ends 174 and 176 of the film to the pallet member 150.

A film fold tucking fin 290 pushes against the film 172 to insert a fold 262 into the loose flexible material 172 to take up any slack in the film about the pocket 178 that is formed between the upper surface 254 of the rigid substrate and the bottom or lower surface 180 of the film 172.

Finally, an accumulating, pallet stacking section 292 counts and stacks the finished packaging pallets for subsequent transportation and optionally banding and palletizing.

Operation of the Apparatus for Forming Shrink Packages

The operation of the above described apparatus for forming shrink packages of the present invention includes the following steps in generally the following order:

a. The film or flexible wrapping material 172 is driven into a forming plow 280 and 284 by the power drive rollers 278 bending it to the right as shown in FIG. 13.

b. The inserted end 174 of the film is picked up by a multi-belt film feeding segment 294 that pulls and pushes the film 172 to the opposite side of the width of the rigid substrate pallet member 150.

c. The film 172 is bent and is driven to a desired location below the rigid substrate pallet member 150 for attachment of the film to the bottom side 168 and 170 of the pallet member 150.

d. The mechanical or heated cut-off blade 260 cuts the flexible wrapping material just above the initial drive roller 278.

e. Generally, while steps a through d are performed, a rigid substrate pallet member 150 is positioned beneath the flexible wrapping material feed assembly 252 to receive the flexible material. The attaching agent 300, primarily glue, is applied to both exposed edges 168 and 170 on the underside of the rigid substrate pallet member 150.

f. Two mechanical tuckers 288, one from each side of the pallet member 150, press the flexible wrapping material 172 onto the glue 300 on the underside of the rigid substrate or is otherwise secured, such as by stapling.

g. The multi-belt feeding system 294 moves upward and out of the way.

h. The film fold tucking fin 290 folds the loose flexible material neatly on top of the finished pallet member 150 and then retracts.

i. Finally, the completed pallet advances forward for stack, bending, palletizing or other processing.

The foregoing disclosure and description of the invention are illustrative and explanatory thereof, and various changes in the size, shape and materials, as well as in the details of the illustrated construction may be made without departing from the spirit of the invention.

I claim:

1. A reusable shrink-wrapping pallet for packages, the invention comprising:

a pallet member formed having essentially rigid first and adjacent second sections, said first section and said second section each including an upper and lower surface and opposing inner and outer edges, said first and second sections of said pallet member being joined along the inner edge of said first section and the inner edge of said second section, said pallet member being adapted to hold a selected object to be secured on the upper surface of said first section of said pallet member, and said first section of said pallet member having a width at least as wide as the object to be secured;

a flexible film having first and second ends being secured to said pallet member near the outer edges of said first and said second sections of said pallet member; said film molding to the contour of the object to be secured upon application of a controlled amount of heat thereto and retaining a memory of the contour of the object to be secured;

an adjustable sized pocket adapted to hold the object to secured therein being formed between the upper surface of said first section of said pallet member and an opposing lower surface of said film;

said pallet member being adapted to fold between said first section and said second section along a primary axis between said inner edge of said first section and said inner edge of said second section of said pallet member, said second section being rotatable about said primary axis such that said lower surface of said second section moves into an opposing relationship to said lower surface of said first section; and, said pocket being reduced in size when said second section is rotated about said primary axis into a position in which the lower surface of said second section is adjacent the lower surface of said first section and said pocket being increased in size when said lower surface of said second section is rotated away from said lower surface of said first section;

whereby the object to be secured can be removed from the pocket of the pallet without tearing of the film securing the object to be secured.

2. The invention of claim 1 wherein said pallet member comprises a parallelogram.

3. The invention of claim 1 wherein said primary axis is parallel to said outer edges of said first and second sections.

4. A reusable shrink-wrapping pallet for packages, the invention comprising:

a pallet member formed having essentially rigid first and adjacent second sections, said first section and said second section each including an upper and lower surface and opposing inner and outer edges, said first and second sections of said pallet member being joined along the inner edge of said first section and the inner edge of said second section, said pallet member being adapted to hold a selected object to be secured on the upper surface of said first section of said pallet member, and said first section of said pallet member having a width at least as wide as the object to be secured;

a flexible film having first and second ends being secured to said pallet member near the outer edges of said first and said second sections of said pallet member;

an adjustable sized pocket adapted to hold the object to secured therein being formed between the upper surface of said first section of said pallet member and an opposing lower surface of said film;

said pallet member being adapted to fold between said first section and said second section along a primary axis between said inner edge of said first section and said inner edge of said second section of said pallet member, said second section being rotatable about said primary axis such that said lower surface of said second section moves into an opposing relationship to said lower surface of said first section; and, said pocket being reduced in size when said second section is rotated about said primary axis into a position in which the lower surface of said second section is adjacent the lower surface of said first section and said pocket being increased in size when said lower surface of said second section is rotated away from said lower surface of said first section;

whereby the object to be secured can be removed from the pocket of the pallet without tearing of the film securing the object to be secured.

5. The invention of claim 4 wherein said pallet member comprises a parallelogram.

6. The invention of claim 4 wherein said primary axis is parallel to said outer edges of said first and second sections.

7. The invention of claim 4 wherein said pallet member comprises:

the pallet member is a rectangle with a first and opposing second edges, a third edge perpendicular to the first edge, and a fourth edge opposing the third edge, said primary axis is parallel to said outer edges of said first and second sections, said outer edges of the first and second sections being the first and second edges of the pallet member.

8. The invention of claim 7 wherein a first ear segment of the pallet member is adapted to rotate about a first segment pivot axis located between the third edge of the rectangle and a point midway between the third and fourth edges of the rectangle when said second section is rotated about said primary axis into a position in which the lower surface of said second section is adjacent the lower surface of said first section.

9. The invention of claim 7 wherein a second ear segment of the pallet member is adapted to rotate about a second segment pivot axis located between the fourth edge of the rectangle and a point midway between the third and fourth edges of the rectangle when said second section is rotated about said primary axis into a position in which the lower surface of said second section is adjacent the lower surface of said first section.

10. The invention of claim 7 wherein:

a first ear segment of the pallet member is adapted to rotate about a first segment pivot axis located between the third edge of the rectangle and a point midway between the third and fourth edges of the rectangle when said second section is rotated about said primary axis into a position in which the lower surface of said second section is adjacent the lower surface of said first section; and, a second ear segment of the pallet member is adapted to rotate about a second segment pivot axis located between the fourth edge of the rectangle and a point midway between the third and fourth edges of the rectangle when said second section is rotated about said primary axis into a position in which the lower surface of said second section is adjacent the lower surface of said first section.

11. The invention of claim 10 further including a container having an interior compatible with a portion of the pallet member extending between the first pivot axis and the second pivot axis adapted to receive the pallet member in the interior.

12. A reusable shrink-wrapping pallet for packages, the invention comprising:

a pallet member formed having essentially rigid rectangular first, main, and second sections; said first section, and said second section each including an upper and lower surface and opposing inner and outer edges; said main section having a first and opposing second edge; said first section of said pallet member being joined along the inner edge of said first section to the first edge of the main section; said second section of said pallet member being joined along the inner edge of said second section to the second edge of the main section; said pallet member being adapted to hold a selected object to be secured on an upper surface of said main section of said pallet member; and said main section of said pallet member having a width at least as wide as the object to be secured;

a flexible film having first and second ends being secured to said pallet member near the outer edges of said first and said second sections of said pallet member;

an adjustable sized pocket adapted to hold the object to secured therein being formed between the upper surface of said main section of said pallet member and an opposing lower surface of said film;

said first section being rotatable about said main section along a first primary axis between said inner edge of said first section and said first edge of said main section of said pallet member, such that said lower surface of said first section moves into an opposing relationship to the lower surface of said main section; said second section being rotatable about a second primary axis between said inner edge of said second section and said second edge of said main section of said pallet member, such that said lower surface of said second section moves into an opposing relationship to the lower surface of said main section;

said pocket being reduced in size when said first section is rotated about said first primary axis into a position in which the lower surface of said first section is adjacent the lower surface of said main section and said pocket being increased in size when said lower surface of said first section is rotated away from said lower surface of said main section; and, said pocket being reduced in size when said second section is rotated about said second primary axis into a position in which the lower surface of said second section is adjacent the lower surface of said main section and said pocket being increased in size when said lower surface of said second section is rotated away from said lower surface of said main section;

whereby the object to be secured can be removed from the pocket of the pallet without tearing of the film securing the object to be secured.

* * * * *